US006849172B2

(12) United States Patent
Rigby et al.

(10) Patent No.: US 6,849,172 B2
(45) Date of Patent: Feb. 1, 2005

(54) ELECTROLYTIC PROCESS AND APPARATUS

(75) Inventors: Gregory David Rigby, Charlestown (AU); Alan David Stuart, New Lambton (AU); Philip Ernest Grazier, Kilaben Bay (AU)

(73) Assignee: BHP Billiton Innovation Pty., Ltd., Melbourne (AU)

( * ) Notice: Subject to any disclaimer, the term of this patent is extended or adjusted under 35 U.S.C. 154(b) by 308 days.

(21) Appl. No.: 10/247,251

(22) Filed: Sep. 19, 2002

(65) Prior Publication Data

US 2004/0011664 A1 Jan. 22, 2004

(30) Foreign Application Priority Data

Apr. 3, 2001 (AU) ..... PR4183
Jul. 18, 2002 (AU) ..... 2002950240

(51) Int. Cl.[7] ..... C25D 21/18; C25B 15/00; F16L 9/18

(52) U.S. Cl. ..... 205/101; 138/111; 138/114; 138/177; 204/232; 204/237; 204/273; 204/279; 205/148; 205/291

(58) Field of Search ..... 205/101, 148, 205/291; 204/232, 237, 273, 279; 138/111, 114, 177

(56) References Cited

U.S. PATENT DOCUMENTS 4,330,380 A * 5/1982 Parkinson et al. ..... 205/101

* cited by examiner

*Primary Examiner*—Robert R. Koehler
(74) *Attorney, Agent, or Firm*—Brinks Hofer Gilson & Lione; G. Peter Nichols

(57) ABSTRACT

A method of operating a cell for electrowinning of copper, the cell including a plurality of anodes and cathodes therein, the method including the steps of introducing fresh electrolyte and sparging gas to a manifold system in the cell, controlling flow of fresh electrolyte and sparging gas in the manifold system and providing outlet openings in the manifold system such that streams of fresh electrolyte and sparging gas from the outlet openings are directed relatively uniformly across the cathodes in the cell.

25 Claims, 9 Drawing Sheets

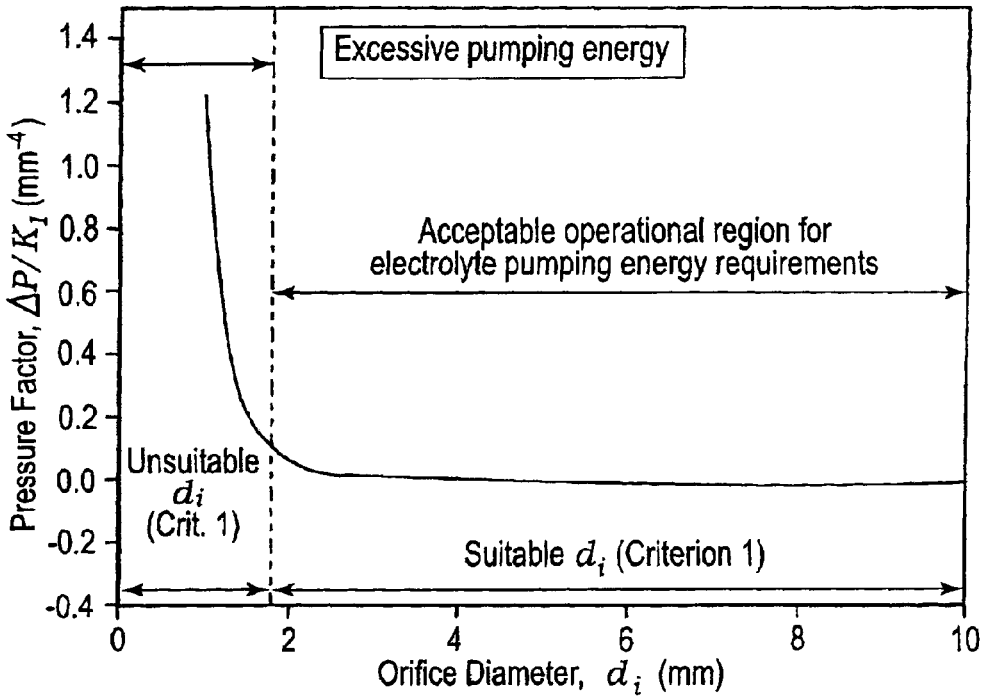
FIGURE 8 Effect of Variation of Orifice Diameter on Pressure Factor and Required Pumping Energy.
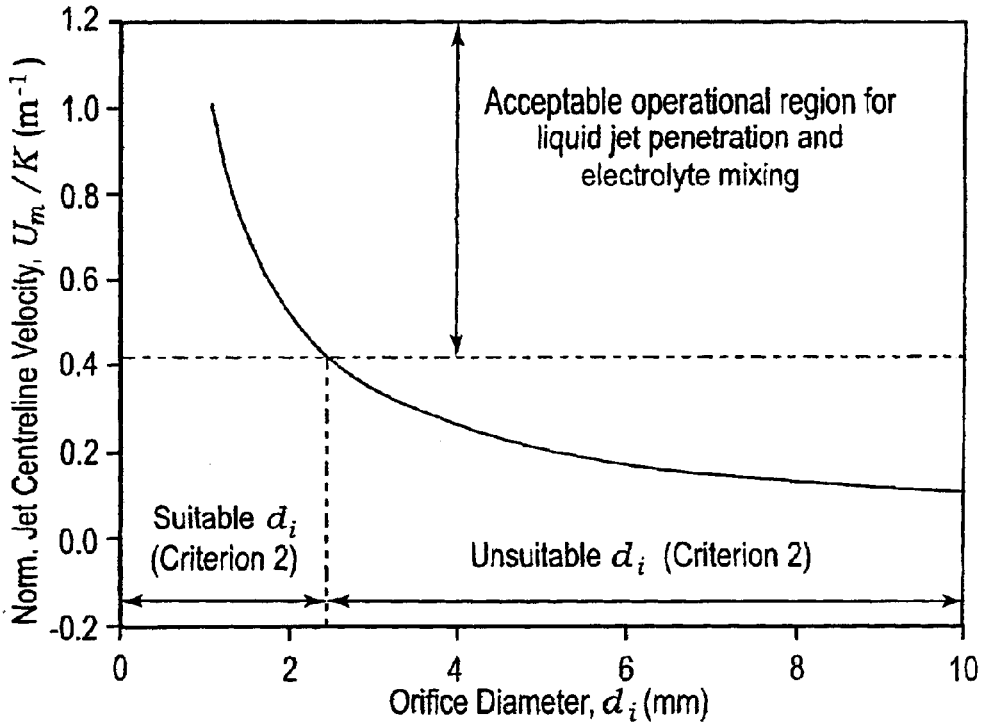
FIGURE 9 Effect of Orifice Diameter on Normalised Jet Centreline Velocity (xm, Qorif = constant).

Variation in Electrolyte Flow through Individual Manifold Orifices.
*Legend:* $d_i$ = 6mm; •, $Q_T/2 = 3 \times 10^{-3} m^3 s^{-1}$ ; ○, $Q_T/2 = 2 \times 10^{-3}$ $m^3 s^{-1}$ Variation in Electrolyte Flow through Individual Manifold Orifices with Orifice Diameter.

FIGURE 12
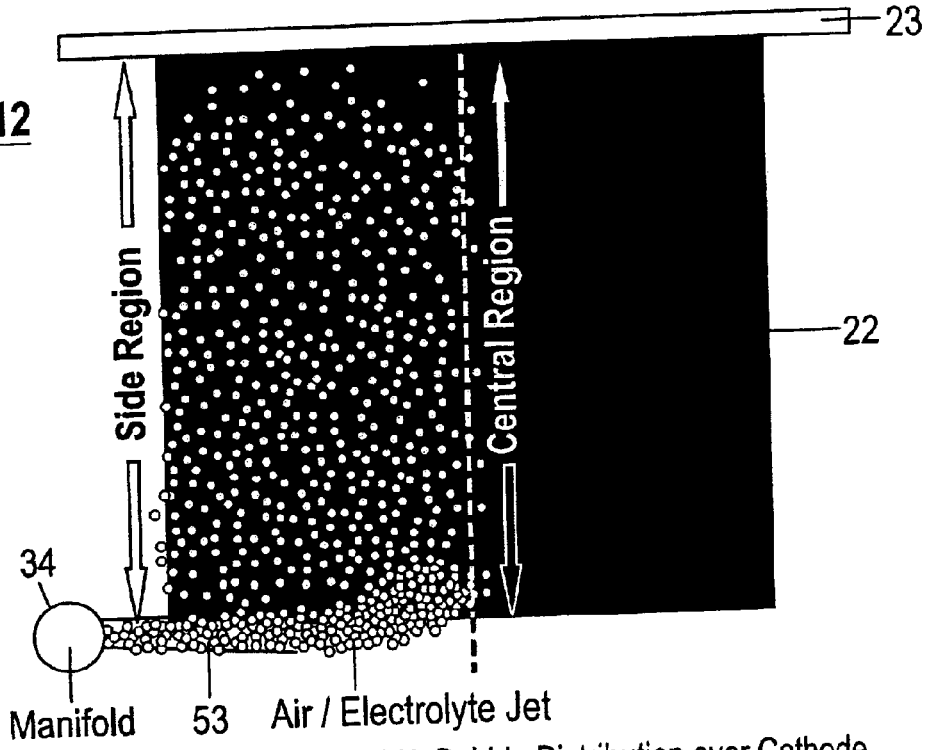
Schematic Representation of Air Bubble Distribution over Cathode Face (Single Jet Only Displayed).
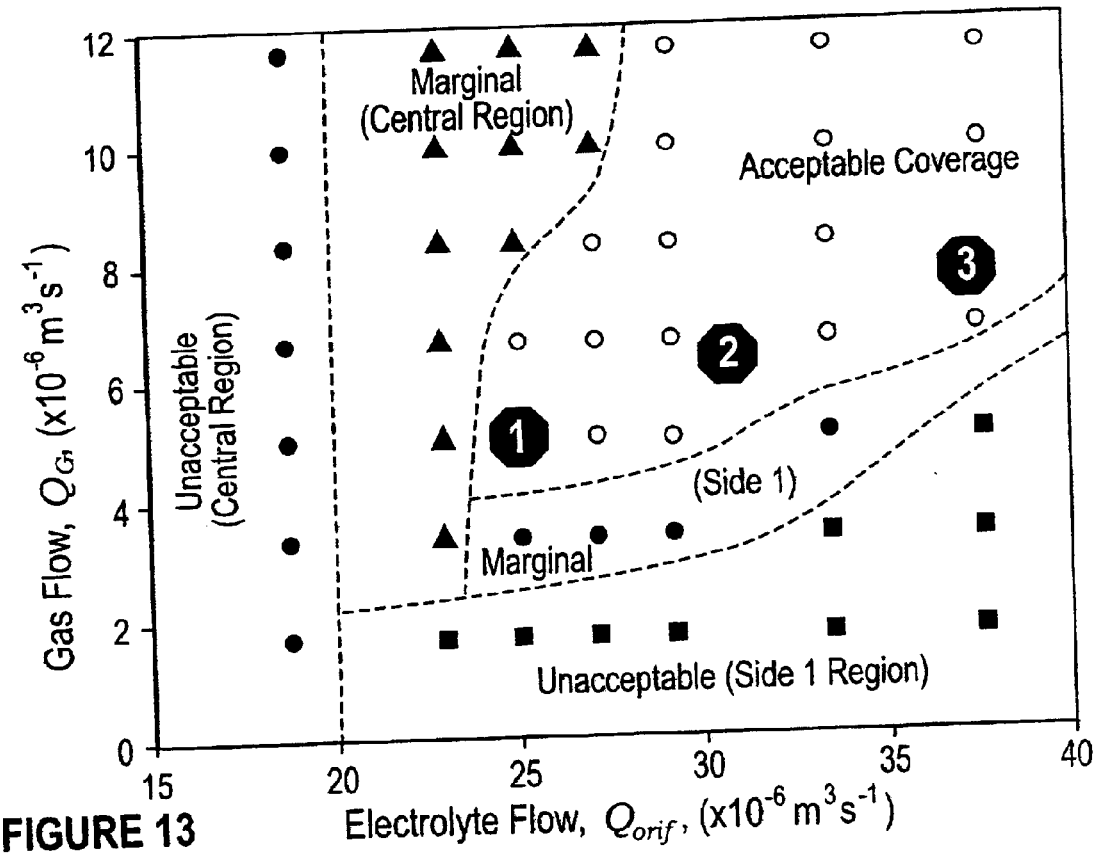
FIGURE 13

ELECTROLYTIC PROCESS AND APPARATUS

This invention claims priority to Australian Patent App. PR 4183/01 filed Apr. 3, 2001, and Australian Patent App. 2002950240 filed Jul. 18, 2002, the entire contents of which are incorporated herein by reference.

This invention relates to an electrolytic process and apparatus.

More particularly, the invention relates to electrowinning of copper.

It is known that the productivity of electrowinning of copper is proportional to the current density. It is not possible, however, to increase the current density substantially above normal practice without making adequate provision for removal of depleted electrolyte boundary layers which tend to form on the electrodes, particularly the cathode, and replacement of the depleted electrode with fresh electrolyte. Various techniques have been proposed for addressing this problem including circulating systems for circulating fresh electrolyte and the use of a sparging gas to cause turbulence adjacent to the electrode plates in order to break up any boundary layers of depleted electrolyte adjacent to the cathode plates.

The object of the present invention is to provide a novel method and apparatus which can be used to improve the productivity of electrowinning of copper.

According to the present invention there is provided a method of operating a cell for electrowinning of copper, said cell including a plurality of anodes and cathodes therein, the method including the steps of introducing fresh electrolyte and sparging gas to a manifold system in the cell, controlling flow of fresh electrolyte and sparging gas in the manifold system and providing outlet openings in the manifold system such that streams of fresh electrolyte and sparging gas from the outlet openings are directed relatively uniformly across the cathodes in the cell.

Preferably, the method includes providing separate conduits for supplying fresh electrolyte and sparging gas in the manifold system and the method further includes the step of providing discharge nozzles which extend from the fresh electrolyte conduit through the sparging gas conduit to entrain sparging gas into the fresh electrolyte prior to being expelled through said outlet openings.

Preferably, the fresh electrolyte conduit is located concentrically within the sparging gas conduit.

Preferably each cathode is in the form of a plate having a lower edge and wherein said outlet openings produce streams of fresh electrolyte and sparging gas which are initially directed generally parallel to the lower edge.

Preferably there is an outlet opening adjacent to the lower edge on each face of the plate, i.e. four outlet openings per cathode plate.

Normally the streams are directed horizontally from nozzles adjacent to the sparging gas conduit.

The invention also provides a cell for electrowinning of copper, the cell including a tank for holding electrolyte, a plurality of alternately disposed electrodes and cathodes, a manifold system for supplying fresh electrolyte and sparging gas to the cell, the arrangement being such that the manifold includes means for controlling flow of fresh electrolyte and sparging gas therein whereby streams of fresh electrolyte and sparging gas discharge from the manifold system relatively uniformly as between the cathodes in the cell.

Preferably the cathodes are in the form of cathode plates which are parallel to one another and each having a horizontally disposed lower edge and wherein the manifold system has outlet openings which direct streams of fresh electrolyte and sparging gas generally parallel to said bottom edges.

Preferably further, the outlet openings are located outwardly adjacent to bottom corners of the cathode plates.

Preferably further, the manifold includes an inner conduit which supplies fresh electrolyte and an outer conduit which supplies sparging gas and wherein the inner conduit is concentrically disposed within the outer conduit.

Preferably further, a plurality of discharge nozzles extend from the inner conduit through the outer conduit so as to discharge jets of fresh electrolyte having sparging gas entrained therein.

The sparging gas is typically about 10% to 30% by volume of fresh electrolyte and preferably about 20% by volume.

In preferred methods of the invention, the energy requirement for pumping the electrolyte is minimised.

Also in preferred embodiments, there is maximisation of mixing of depleted electrolyte across the electrode face.

Also in preferred embodiments, there is minimisation of the difference in individual orifice flow rates.

The invention will now be further described with reference to the accompanying drawings, in which:

FIG. 8 is a graph showing the effect of variation of orifice diameter on pressure factor and required pumping energy;

FIG. 9 is a graph showing the effect of orifice diameter on normalised jet centre line velocity;

FIG. 12 is a schematic representation of air bubble distribution over the cathode face; and FIG. 13 is a flow map for bubble coverage over the cathode from electrolyte jets.

Figure 1:
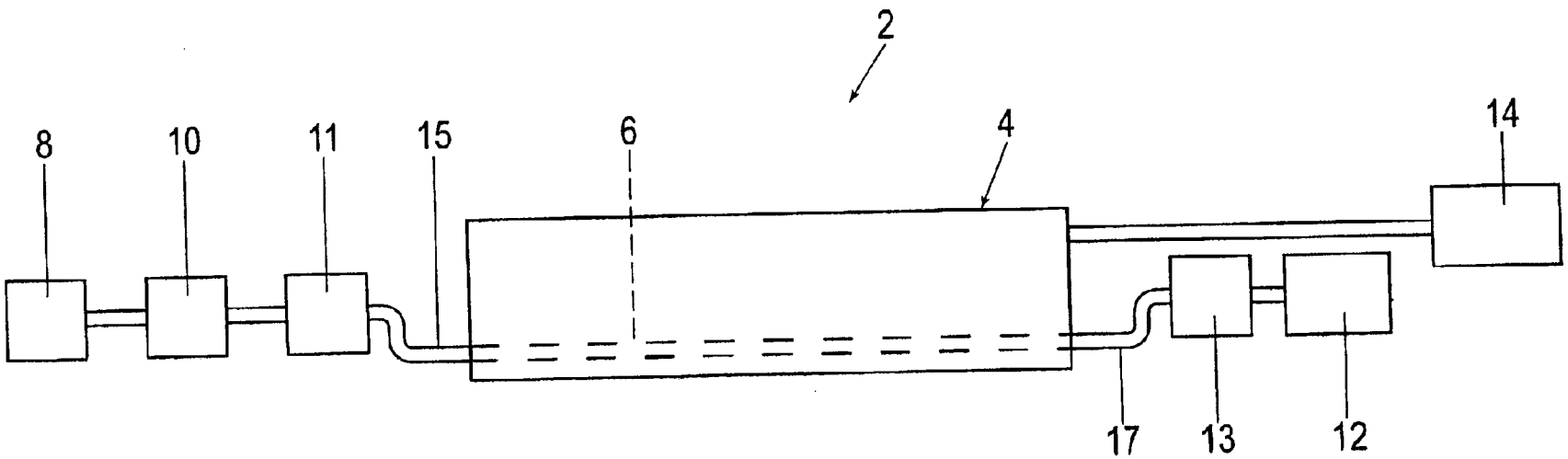
FIG. 1 is a schematic view of copper electrowinning apparatus of the invention.

FIG. 1 diagrammatically illustrates copper electrowinning apparatus 2 including an electrolytic cell 4 having a manifold system 6 which is supplied with fresh electrolyte from a source 8 of fresh electrolyte by means of a pump 10. A filter 11 may be provided after the pump 10 in order to filter out any particulate matter of diameter greater than around 0.5 mm so as to avoid clogging of outlets in the manifold system 6. The filter 11 is located in an electrolyte supply line 15 which is connected to the manifold system 6. A sparging gas generator 12 is arranged to deliver gas at a predetermined flow rate so that gas bubbles can be introduced into the fresh electrolyte before being admitted to the cell 4. The sparging gas is preferably air. Spent electrolyte is collected in a spent electrolyte collector 14 for reprocessing or the like.

The sparging air generator 12 can be of known type and therefore need not be described in detail. It preferably comprises an air compressor which produces air having a pressure in the range 200–500 kPa. In order to reduce crystallisation growth in the manifold system 6 compressed air from the compressor 12 is humidified by means of a humidifier 13. Normally, the humidifier 13 humidifies the air so as to be saturated with water vapour. The amount of water vapour in the air depends on pressure and temperature, in the usual way. The humidifier is located in a sparging gas supply line 17 which is connected to the manifold system 6.

Figure 2:
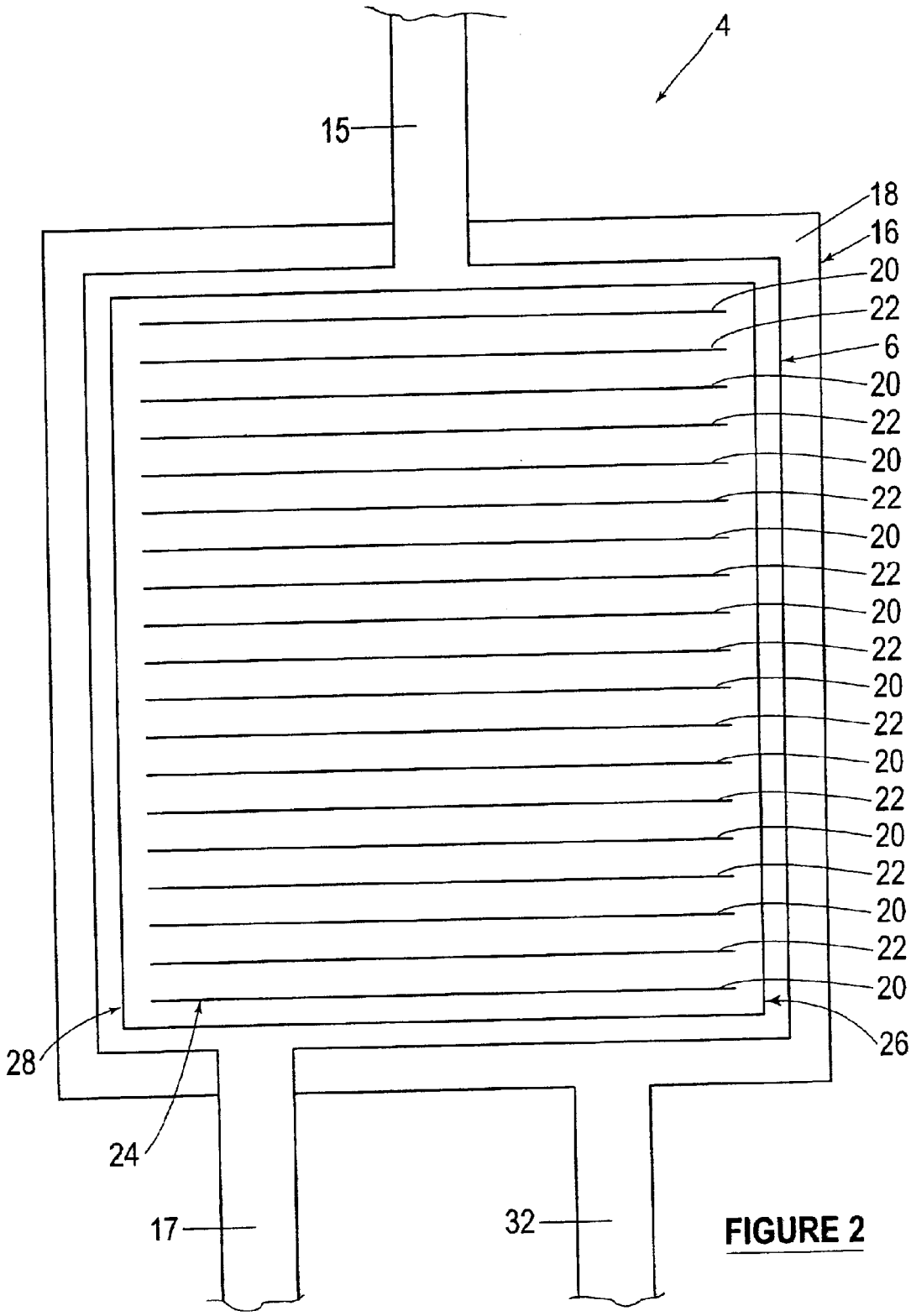
FIG. 2 is a plan view of a cell of the invention.
Figure 4:
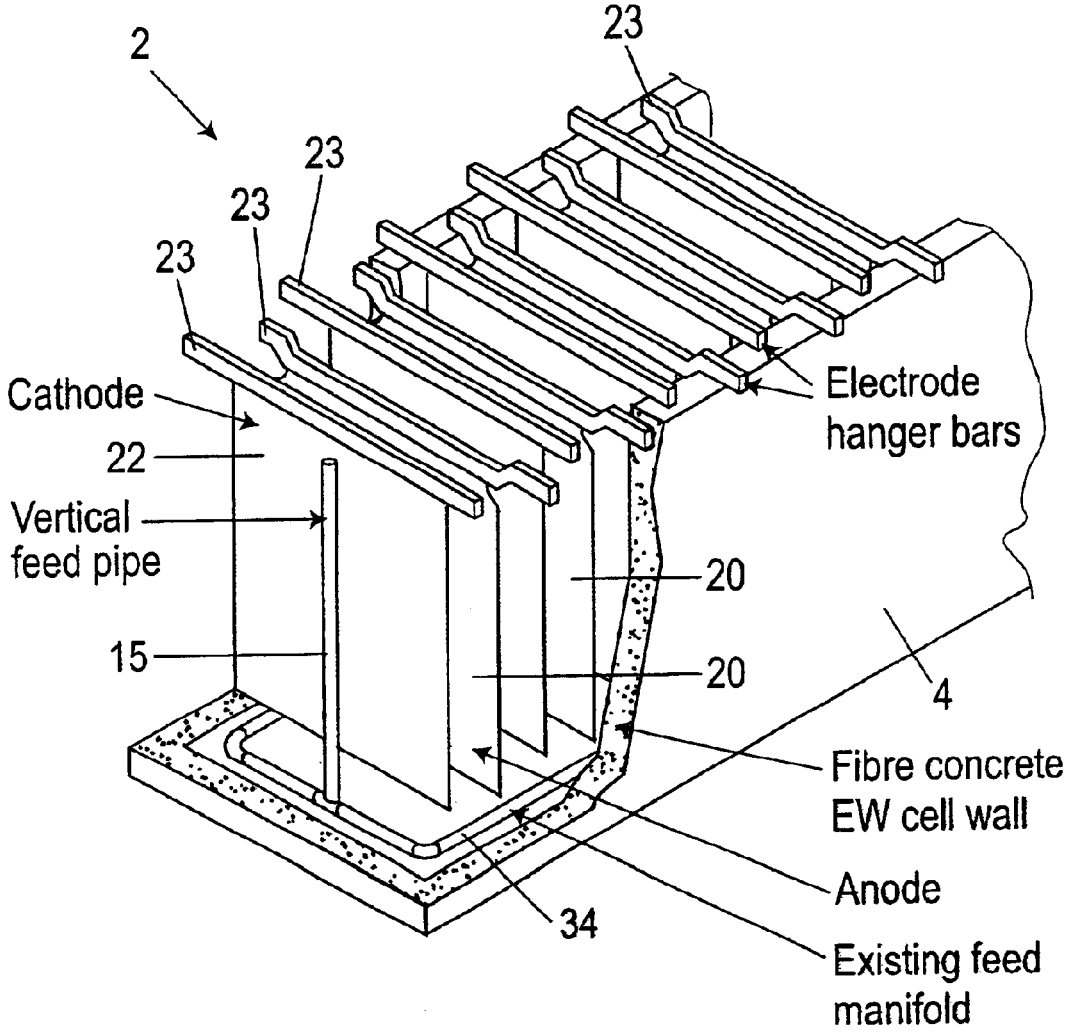
FIG. 4 is a fragmentary perspective view of the cell.

The cell 4 is schematically illustrated in plan view in FIG. 2. It will be seen that the cell 4 includes a tank 16 which contains electrolyte 18. The tank 16 includes a plurality of anodes 20 and cathodes 22 which are alternately disposed along the length of the cell. The anodes and cathodes are supported by electrode hanger bars 23 in the usual way, as shown in FIG. 4. Preferably, the cathodes are in the form of flat cathode plates 24. Typically the cathode plates 24 are made from stainless steel plates say 3 mm in thickness and about 1 metre square. The spacing between cathode plates is typically of the order of 100 mm.

Figure 3:
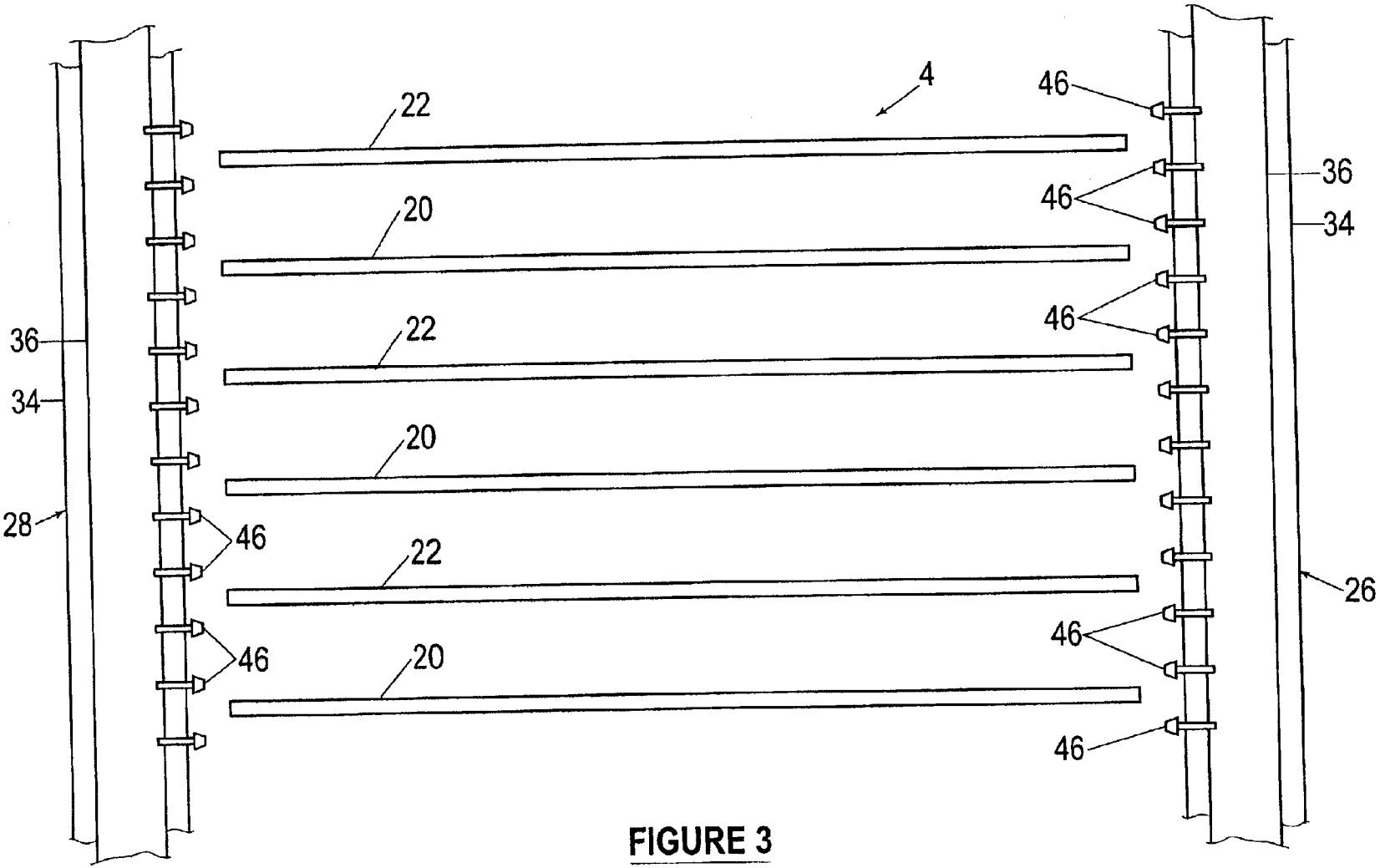
FIG. 3 is a fragmentary plan view through the cell.
Figure 5:
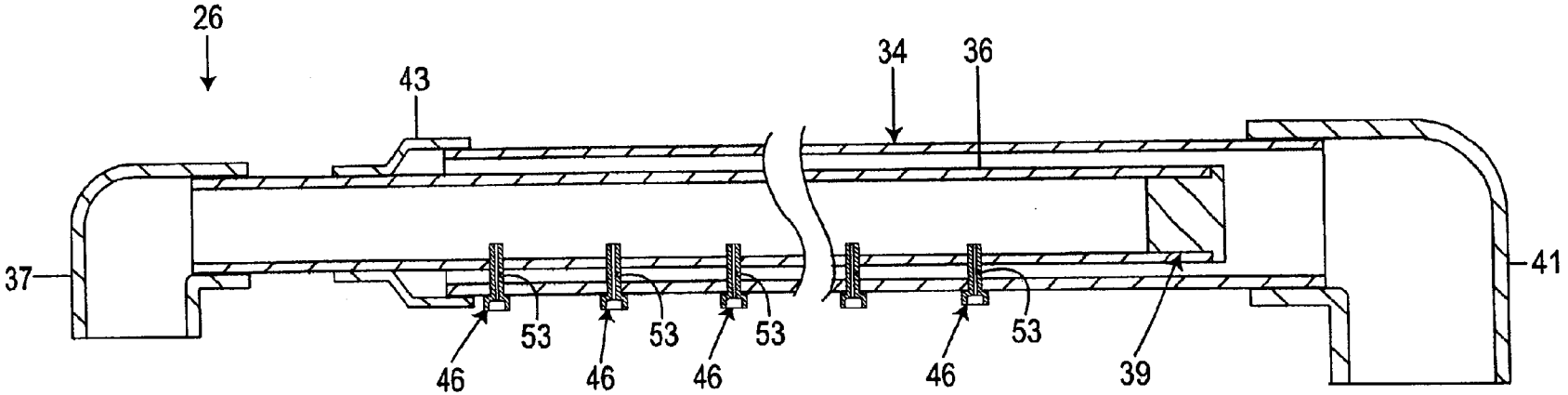
FIG. 5 is a schematic longitudinal cross-section through part of the sparging manifold.

The manifold system 6 includes two longitudinally extending lines 26 and 28 which are located near the bottom of the tank 16 and laterally of the bottom edges 30 of the cathode plates 24, as best seen in FIGS. 3 and 5. The lines 26 and 28 are located beneath the lower level of the bottom edges 30 by about 25 mm and about 25 mm laterally from the side edges 31 thereof. The tank 16 includes an outlet 32 for discharging spent electrolyte to the spent electrolyte collector 14.

FIG. 5 shows the manifold line 26 in more detail. The line 28 is essentially the same and therefore need not be described. The line 26 includes a longitudinally extending outer conduit 34 in which a longitudinally extending concentrically arranged inner conduit 36 is disposed. The outer conduit 34 may typically comprise a 2" schedule 40 PVC pipe having a wall thickness of say 2 or 3 mm. The inner conduit 36 may typically comprise a 1¼" schedule 40 PVC pipe again having a wall thickness in the range 2 to 3 mm. One end of the inner conduit 36 is connected to an elbow 37. The other end is provided with a PVC plug 39. One end of the outer conduit 34 is mounted in an elbow 41 and the other is connected to a reducer bushing 43, the inner socket of which is bonded to the outer surface of the inner conduit 36, as shown. The elbow 41 is connected to a compressed air supply line which receives humidified compressed air from the humidifier 13. The elbow 37 is connected to a supply line which receives fresh electrolyte from the pump 10 via the filter 11. In one convenient arrangement, the pump 10 could be air operated by compressed air from the compressor 12.

Figure 7:
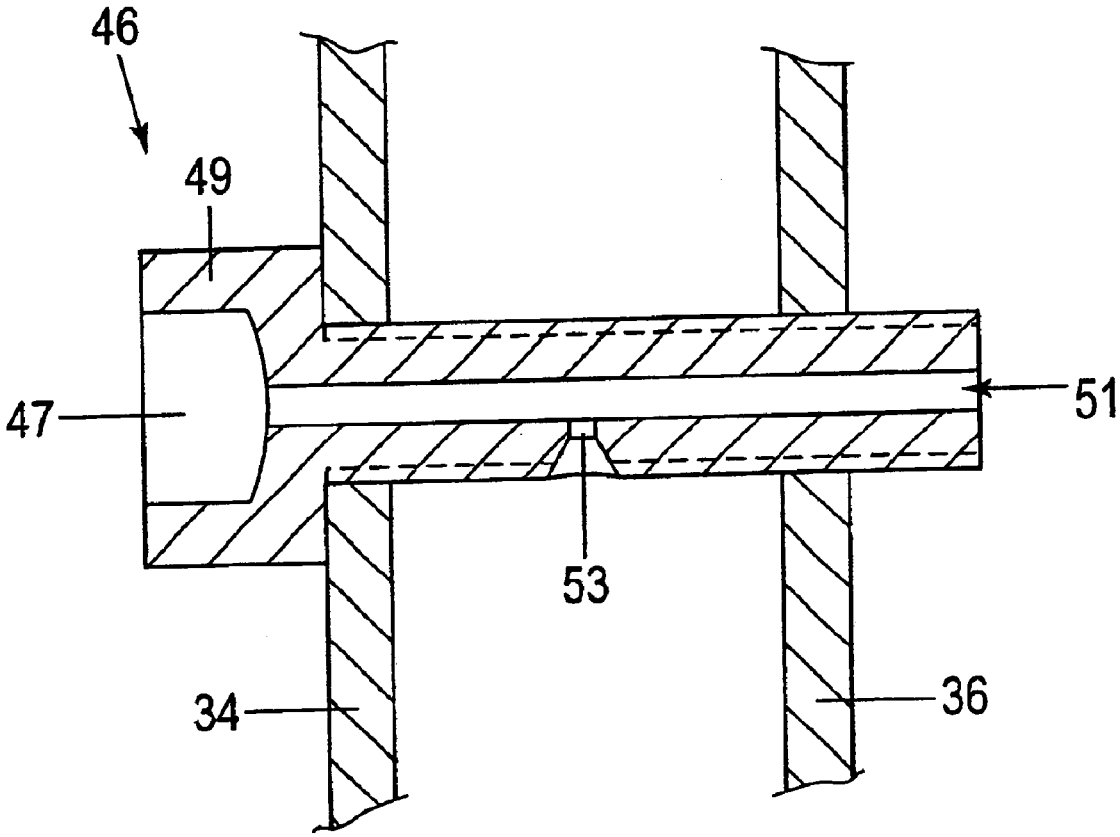
FIG. 7 is a longitudinal section through a discharge nozzle.

The line 26 includes a plurality of discharge nozzles 46 which extend from the interior of the inner conduit 36 to the exterior of the outer conduit 34. One of the discharge nozzles 46 is diagrammatically shown in FIG. 7. In this arrangement, the nozzle is made from a modified form of stainless steel screw (M6×16) having an allen socket 47 in its head 49. A bore 51 extends longitudinally through the shank of the screw and the diameter in the illustrated arrangement is 1.7 mm. Approximately midway along the length of the screw is a lateral opening 53 which opens to the bore 51. The opening 53 could be a straight bore or tapered as shown in FIG. 7. It has a diameter of about 1.2 mm or is about 1.2 mm wide at the point where it joins the bore 51 in the case where it is tapered. The shaft of the screw is externally threaded.

The function of the discharge nozzles 46 is to permit electrolyte from the inner conduit 36 and air from the outer conduit to be expelled together in a jet towards the lower edge 30 of the cathodes 22, as will be described in more detail below. The openings 53 permit compressed air from the outer conduit 34 to be entrained into the electrolyte flow passing through the bore 51 to be discharged into the inner conduit 36. The entrained air takes the form of gas bubbles of typical size range 0.5–3.0 mm. These gas bubbles constitute the sparging gas for the cell. The sparging air pressure is therefore always greater than the pressure of the fresh electrolyte in the inner conduit 36. Preferably, the sparging gas pressure is 25 to 75% higher than the electrolyte pressure.

The discharge nozzles 46 are threadably mounted in aligned holes in the conduits 34 and 36 and therefore the discharge nozzles maintain proper spacing of the conduits 34 and 36. Alternatively, spacing elements could be provided to maintain correct spacing of the conduits.

Figure 6:
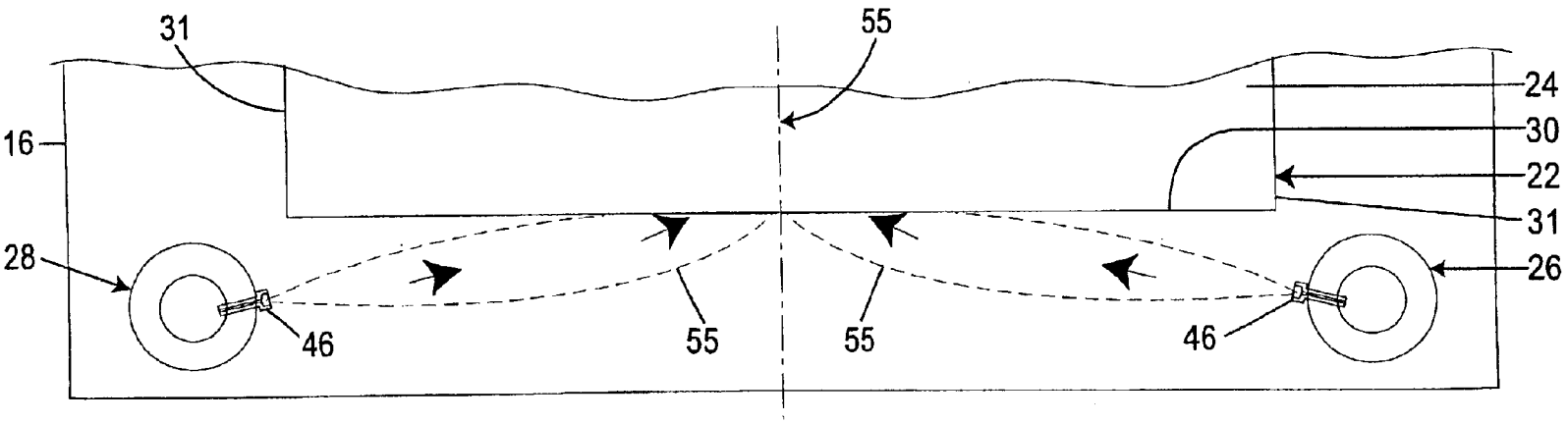
FIG. 6 is a fragmentary axial view through part of the cell.

FIG. 3 illustrates schematically the plan view of part of the cell 4. As can be seen from this drawing, the discharge nozzles 46 are equispaced along the manifold lines 26 and 28. The spacing of the discharge nozzles 46 is half of the spacing between the anode and cathode plates 20 and 22, as shown. In one arrangement, the spacing between the plates 20 and 22 is 101.6 mm and the centres of the discharge nozzles are 50.8 mm apart, each pair of discharge nozzles 46 being equally spaced relative to opposite faces of the anode and cathode plates 20 and 22, as shown. As shown in FIG. 6, the discharge nozzles 46 are horizontally disposed and produce jets 55 of fresh electrolyte and sparging air bubbles across both faces of the cathode plate 22. This causes removal of depleted electrolyte boundary layers which tend to accumulate on the faces of the cathode electrode 22 and thus permits operating of the cell at a higher current density.

The discharge nozzles 46 have an outlet nozzle of about 2 mm which is sufficient to produce jets 55 which extend for a distance of about 0.6 to 0.7 metres, that is to say more than halfway across the face of the cathode electrode 22. Normally the nozzle diameter would be in the range from 1.0–3.0 mm. In addition, the sparging air introduced into the cell is in the form of bubbles with the typical size range of 0.5–3.0 mm in diameter.

In the cell of the invention the feed electrolyte is transported down through the vertical feed line 15 before splitting into the two horizontal lines 26 and 28 of the manifold 6. Along the length (≈6 m) of both lines 26 and 28, outlet nozzles 46 may be located at spacings corresponding to the positions for the generation of jets 55 on each side of the electrode (i.e. 120 jets for each manifold arm for a 60 cathode cell). The total flow of fresh electrolyte into each cell, $Q_T$, is related to the mass flux of copper $M_M$; and the required "strip" of copper ions, $C_S$, depleted from the electrolyte during residence in the cell—and is determined by the current density applied to each cell, $I_D$; number of cathodes, $n_C$; and the surface area per cathode available for plating, $A_C$; i.e.

$$Q_T = \frac{M_M}{C_S} = \frac{n_C A_C I_D W_M}{c_I F C_S}, \tag{1}$$

where $c_i$ is the ionic charge of the metal plating ion; $C_S = C_i - C_o$, and $C_{i,o}$ are the inlet and outlet concentrations respectively of $Cu^{2+}$; F is Faraday's constant; and $W_M$ is the molecular weight of copper.

The possible variables available for manipulation during the design of manifold orifices include the total electrolyte flow rate into each cell, and the orifice diameter. However, examination of eqn. (1) shows that for a given cell configuration, plating ion species, current density rate and electrolyte strip, $Q_T$ for each cell is fixed, and therefore the only available option for the modification of mixing intensity around the cathodes is through the manipulation of the orifice diameter, $d_i$. In the cell of the invention some parameters can be optimised as follows:

Criterion 1: minimisation of energy requirements for electrolyte pumping—this is primarily related to the pressure drop across each manifold orifice.

Criterion 2: maximisation of mixing across electrode face—this is characterised by the predicted jet centreline velocity, $U_M$, at a penetration distance equivalent to half the total width of the electrode, and is also important for the subsequent generation and dispersion of gas bubbles.

Criterion 3: minimisation of the difference in individual orifice flowrates, $Q_i$, through each orifice on the manifold leg—this is related to interconnected pressure drop between the flow in the main manifold and the pressure drop through each outlet orifice.

A description of the theory related to Criteria 1 to 3 is set out below.

Minimisation of Energy Requirements for Electrolyte Pumping—Criterion 1

The scale of operation in many industrial electro winning plants means that energy required for the pumping of electrolyte through the manifold can be a significant component of total operating cost, since a single tank house may comprise over 500 cells, each of which contains two manifold arms, often around 60 cathodes, and 4 orifices per cathode (120 orifices per manifold arm in this example). For design purposes the electrolyte flow through each orifice can be modelled using the standard orifice equation, $$Q_{orif} = \frac{\pi d_i^2 C_O}{4}\sqrt{\frac{2\Delta P}{\rho_e}}, \tag{2}$$

where $Q_{urit}$ is the electrolyte flow rate through the orifice, $C_O$ is the orifice coefficient;

$$\frac{\pi d_i^2}{4} = A_O$$

is the area of the orifice; $\Delta P$ is the pressure drop across the orifice; and $\rho_e$ is the electrolyte density. Rearrangement of eqn. (2) gives $$\Delta P_i = \left[\frac{\rho_e}{2}\left(\frac{4Q_{orif}}{\pi C_O}\right)^2\right]\frac{1}{d_i^4} = \frac{K_1}{d_i^4}. \tag{3}$$

In eqn. (3), $K_1$ is a constant parameter for a fixed $Q_{urit}$ and cell geometry, and the pressure drop is then inversely proportional to $d_i^4$.

Maximisation of Mixing across Electrode Face—Criterion 2

Design modelling of the extent of mixing across the cathode face that results from the electrolyte jet issuing from the orifice is assumed to be directly related to a jet centreline velocity as predicted at the centre of the cathode. Detailed modelling of transient velocity profiles in the cells could be possible through the use of modern CFD techniques, however, the semi-analytical Toll mien solution for a round, unconfined jet is thought to provide sufficient detail, and has been utilised. A large number of variations to empirically-determined constants within the Toll mien solution can be found in literature, however the following formula has been utilised.

$$\frac{U_m}{U_O} = \frac{\pi U_m d_i^2}{4Q_i} = 6.3\frac{d_i}{x_m}, \tag{4}$$

where $U_m$ is the jet centreline velocity; $U_O = Q_{urit}/A_i$ is the electrolyte velocity at the orifice; and $a_m$ is the horizontal distance from the orifice. In a similar fashion to eqn. (2), the above eqn. (4) can be rearranged to yield a relation between $U_m$ and $d_i$, i.e.

$$U_m = 6.3\frac{4Q_{orif}}{\pi d_i x_m} = \frac{K_2}{d_i}, \tag{5}$$

where $K_2$ is a parameter maintained constant for a fixed $Q_{orif}$, cell geometry, and specifically set position for $x_m$. For these condition, the pressure drop can be seen to be inversely proportional to $d_i$.

Flow through Multiple Orifices in a Manifold—Criterion 3

A mathematical model of the distribution flow of electrolyte from feed pipes in electrowinning cells can be defined by application of Bernoulli's equation along streamlines connecting the distribution pipe inlet to the outlet distribution orifices on the pipe surface.

In the model, a number of assumptions are made regarding the electrolyte flow through the system. These assumptions are: (i) that the flow in the pipe in one-dimensional, implying plug flow conditions and negligible variation in pressure across any cross-section of the pipe; and (ii) the friction losses along the pipe between each of the holes can be neglected, and are small in comparison with other pressure losses in the system. This condition can be justified for situations where the diameter of the pipe is small in comparison with each of the holes.

Application of Bernoulli's equation to a pipe containing n orifices gives $$\frac{P_i}{\rho_e} + \frac{U_i}{2} = K_3, \tag{6}$$

where $P_i$ is the pressure drop across orifice i, $Q_i$ and $U_i$ are the volumetric flow rate and velocity respectively in the pipe approaching orifice i, $K_3$ is a constant, and $\rho_e$ is the electrolyte density, which is assumed constant.

The orifice flow can also be expressed as $$Q_{orif} = Q_i - Q_{i-1}. \tag{7}$$

It should be noted that using the formulation described in eqns (6) and (7) the orifices are numbered from last to first. Using this structure a series of equations can be written, accounting for the flow through each orifice, and resulting in a complicated system of n non-linear, interconnected equations which can be solved simultaneously, using numerical techniques.

For the situation where the pipe contains many holes, all of similar size, the flow may be modelled by a continuous model (rather than one containing many discrete holes). This differential system reduces to $$\frac{dQ_{orif}}{i} = C_d A_i\sqrt{\frac{2P_i}{\rho_e}} = C_d A_i\sqrt{\frac{2P_i K_3}{\rho_e}}\left(\sqrt{1 - \frac{Q_{orif}^2}{2K_3 A_0^2}}\right). \tag{8}$$

Equation (8) can be integrated to give $$Q_{orif}(i) = A_0\sqrt{2K}\sin\left[i\left(\sqrt{\frac{P_i}{2}}\right)\left(\frac{C_d A_i\sqrt{\frac{2}{\rho_e}}}{A_0}\right)\right]. \quad (9)$$

Note that equation (6) is valid for $$i < \frac{\pi A_0\sqrt{2}}{2C_d A_i\sqrt{\frac{2}{\rho_e}}}.$$

Larger values of i result in non-physical solutions. In practice, the maximum variation in the individual values of $Q_{orif}^2$ along the manifold, as described by eqn (9) can be minimised by the selection of $d_i$ to ensure that the relations described in Criteria 1 and 2 (which relate to the flow at a specific orifice) are valid for all orifice along the length of the complete manifold arm.

Experimental Results

Two separate prototype cells have been used for the experiments which are described below. These included: (i) a model of the single leg of an electrolyte distribution manifold, where liquid and gas-liquid flow through a novel discharge nozzle 46 could be observed along the manifold length; and (ii) a pilot-plant scale copper electrowinning cell that allowed experiments to be conducted using a series of industrially-sized electrodes. These examples are described below.

The experimental trials relating to the simulation of the flow of electrolyte and gas bubbles out of a cell manifold through the orifices, were conducted in a large steel-framed tank of dimensions 6 m long by 0.8 m wide by 1.2 m high. The tank contained clear acrylic viewing windows along the length of the tank and was not acid resistant, so an artificial electrolyte comprising 0.3M NaCl in water was used—this is comparable to normal plant electrolyte in density and viscosity, and has the additional important similarity in that bubbles present in either medium do not readily coalesce. Due to space limitations in the viewing tank, only one of the two arms of the manifold was simulated, and the total manifold length was slightly truncated (equivalent to 52 cathodes instead of the full-scale 60 cathodes of industrial EW cells), however this was still of sufficient scale to allow the flow visualisation and modelling verification to be conducted.

The electrolyte was continually circulated through the manifold by a variable flow centrifugal pump circuit. The total flowrates of the electrolyte and air streams into the manifold were measured using ultrasonic and variable area flowmeters, and the pressure of each stream was noted immediately prior to entry into the manifold. Individual flows from each orifice were measured using a modified double-valve void fraction probe that contained a tightly fitting pipe which sealed over the discharge bolt being tested and also allowed a volumetric flow measurement of the electrolyte after air disengagement from the fluid in an overflow pipe.

The manifold of the invention was tested using a fully automated 5 000 A industrial-scale electrowinning pilot plant. This plant is capable of operation with up to seven full-scale (1 $m^2$) electrodes, however for these trials, a one cathode/two anode electrode set was utilised. Four discharge nozzles 46—one for each half face of the cathode were used.

Two sets of electrowinning trials were conducted to evaluate the effectiveness of the electrolyte delivery system. Table 1 lists the operational parameters employed in each trial.

TABLE 1

Operational Parameters for Electrowinning Trials

| | Trial EW1 | Trial EW2 |
|---|---|---|
| Cathode type | Stainless steel V-base | Stainless steel V-base |
| Anode type | Semi-precious mesh covering Pb—Sn base | Semi-precious mesh covering Pb—Sn base |
| Electrolyte strip ($g_{cu2+}$ $kg^{-1}$) | 2 | 2 |
| Feed comp. (g $kg^{-1}$ $H_2SO_4$) | 130–150 | 130–150 |
| Feed comp. (g $kg^{-1}$ $Cu^{2+}$) | 30–40 | 30–40 |
| Current density (A $m^{-2}$) | 600 | 600 |
| Applied voltage (V) | 2.0 | 2.0 |
| Electrolyte Temperature (C.) | 50 | 50 |
| Orifice diameter (mm) | >6 | 2 |
| Electrolyte flow ($\times 10^{-6}$ $m^3$ $s^{-1}$) | 37.5 | 37.5 |
| Gas flow* ($\times 10^{-6}$ $m^3$ $s^{-1}$) | — | 7.5 (per 2 mm orifice) |

Results and Discussion

A methodology for the selection of the optimal diameter, $d_i$, for the manifold discharge nozzle orifice, i.e. the diameter of the bore 51, based on three simplified single-phase criteria was discussed above and described in eqns. (3), (5) and (9). The criteria are firstly evaluated for experimental conditions described in Table 1 to determine the diameter $d_i$. Once $d_i$ has been fixed, the applicability of this determination technique to the gas-liquid operating system, and the sensitivity to variations in electrolyte and air flowrates is evaluated and presented in terms of an operating flow map. Following this, results of electrowinning pilot-scale operations using the discharge nozzles are described.

Optimal Design of Orifice Diameter

FIG. 8 shows the relationship between the required electrolyte pumping energy (in terms of pressure loss) and $d_i$ as described in eqn. (3). In this figure, if $K_1$ is maintained constant (by setting a constant $Q_{orif}$ for all orifices along the manifold, then it can be seen that there is a sharp decrease in the curve for $0 \approx \leqq d_i \leqq 1.9$ mm, beyond which there is little variation in the required pressure. Based on the criterion of minimisation of pumping energy (Criterion 1 in Section 2.1), an orifice diameter of $d_i > 1.9$ mm should be selected.

In FIG. 9, the effect of orifice diameter on the jet centre-line velocity, $U_m$ normalised for $Q_{orif}$ and centreline spatial position, $x_m$, is considered. For the design of the discharge bolt, the level of $U_m$ is considered to act as a measure of the degree of mixing in the fluid across the cathode face. The figure shows that due to the inverse relationship with $d_i$, the centreline-velocity, $U_m$ decreases rapidly as $d_i$ is increased, and Criterion 2 for maximisation of electrolyte mixing is indicated to occur for $d_i < 2.5$ mm.

Figure 10:
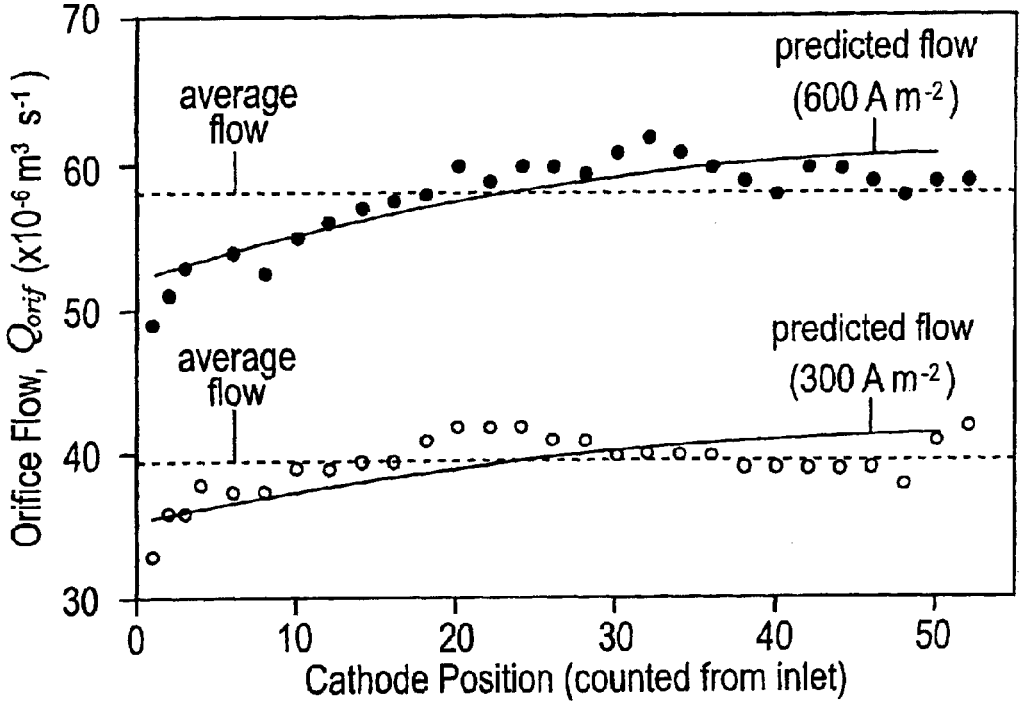
FIG. 10 is a graph showing the variation in electrolyte flow through individual discharge nozzles.

The equal application of the two criteria (1 and 2) for minimisation of pumping energy and maximisation of electrolyte mixing eqns. (3) and (5) to all orifices along the manifold depends upon a even rate of flow from all orifices. In eqns. (6) to (9), a model for the prediction of $Q_{orif}$ was developed, however before applying this model, experimental verification was conducted using the prototype cell described above. FIG. 10 shows a comparison of experimental measurements with the predicted variation in orifice flow for one manifold arm and $d_i$=6 mm—corresponding to typical operating conditions in industrial plant prior to discharge bolt modifications. From the figure it can be firstly be seen that for two sets of conditions, relating to operation at 300 and 600A $m^{-2}$ with a strip of 2 $g_{Cu2+}kg^{-1}$, the flow of electrolyte out of the manifold was investigated and found to be uneven—deviating significantly from the average flow—with the flow associated with the first −20% cathode positions having a much reduced flow compared with that for the remainder along the manifold. It can also be seen that there is reasonable agreement between the model of eqn. (9) and the experimental data.

Figure 11:
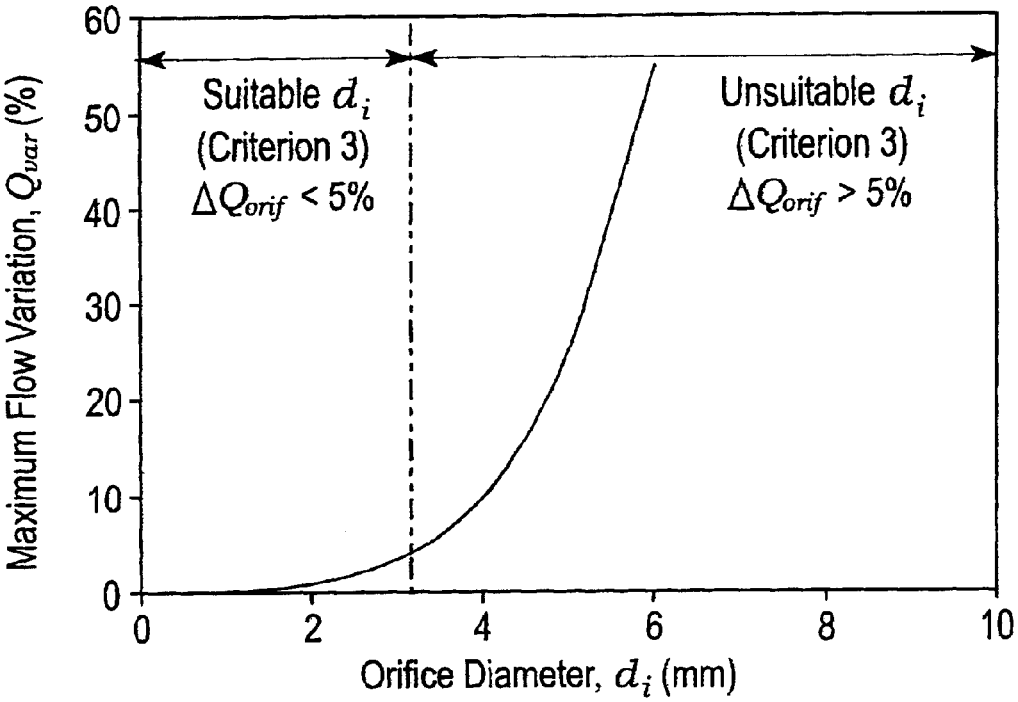
FIG. 11 is a graph showing the variation in electrolyte flow through discharge nozzles as a function of orifice diameter.

In FIG. 11, the model predictions are given for the maximum variation in flow $$Q_{ave}(\%) = \left(\frac{Q_{orif(\max)} - Q_{orif(\min)}}{Q_{orif(\max)}}\right) * 100,$$

as a function of $d_i$ for $Q_T$ equivalent to operation at 600 A $m^{-2}$. FIG. 11 shows that for a suitable maximum limit of 5% variation in $Q_{ave}$, the criterion for minimising the variation in electrolyte flow from orifices along the manifold occurs for $d_i$<3.25 mm.

The design criteria for the orifice diameter $d_i$ presented in FIGS. 8 to 11 indicate that $1.9 \leqq d_i \leqq 2.5$ mm provides the range in which the three stated criteria can be satisfied. Based on this data, an orifice diameter of $d_i$=2.0 mm was selected for the subsequent gas-liquid and electrowinning trials.

Operating Conditions for Discharge Nozzles

FIG. 12 shows a schematic representation of the operation of a gas-liquid jet from one side of the manifold, defines a side and central region on the cathode 22. For a selected orifice diameter the extent of coverage of the gas bubbles across the half face of the cathode is determined by the rates of gas and electrolyte flow through the orifice, and adequate mixing in the region close to the cathode relies upon an even coverage of bubbles across the whole half face of the cathode. In FIG. 12, a flow map of experimental observations of the behaviour of the air-electrolyte jets is given. For $Q_{orif}$<20×$10^6$ $m^3$ $s^{-1}$, the figure shows that there is insufficient momentum within the jet 53 to enable the bubbles to penetrate sufficiently into the cell to provide coverage in the centre of the electrode, and performance is deemed to be unacceptable in that region. Similarly, for low air flows ($Q_{orif}$<20×$10^6$ $m^3$ $s^{-1}$) the low air void fraction in the jet allows the bubbles to be fully entrained within the jet, meaning that no disengagement occurs close to the manifold, and performance is unacceptable in the side region. Between these two extremes, a region of acceptable coverage occurs, surrounded by regions of marginal performance. The expected target operating conditions for higher current density ($Q_G/Q_{orif}$=0.2; $I_D$=400, 500, 600 A $m^{-2}$) are also marked on FIG. 13 and fall within the region of acceptable coverage, indicating that the selection of a discharge bolt orifice diameter of $d_i$=2 mm does not preclude operation within a range of industrial conditions. Operating parameters relating to the total required pressure within gas and liquid feed systems, and frictional pressure losses during the flow are given in Table 2.

TABLE 2

Experimental Flow Conditions for Variation in Current Density During Electrowinning

| | Flow Conditions (Strip = 2 $g_{Cu^{2+}}$ $kg^{-1}$) | | |
|---|---|---|---|
| | 400 A $m^{-2}$ (Point 1, FIG. 7) | 500 A $m^{-2}$ (Point 2, FIG. 7) | 600 A $m^{-2}$ (Point 3, FIG. 7) |
| Electrolyte flow (×$10^{-6}$ $m^3$ $s^{-1}$) | 25 | 31 | 37.5 |
| Gas flow (×$10^{-6}$ $m^3$ $s^{-1}$) for $Q_G/Q_T$ = 0.2 | 5.0 | 6.2 | 7.5 |
| $\Delta P_{Pathway}$ (kPa), excluding nozzle | 8 | 10 | 17 |
| Static Electrolyte Head (kPa) | 11 | 11 | 11 |
| $\Delta P_L$ (kPa) for $Q_G$ = O | 98 | 126 | 150 |
| $\Delta P_L$ (kPa) for $Q_G/Q_T$ = 0.2 | 98 | 130 | 168 |
| $\Delta P_G$ (kPa) for $Q_G/Q_T$ = 0.2 | 13 | 25 | 32 |

Electrowinning Trials

Following the appropriate design of the discharge bore diameter $d_i$ and selection of electrolyte and air flow operating parameters, pilot scale electrowinning trials were conducted. In the first trial, no gas sparging was employed, and the electrolyte was introduced into the cell through orifices with $d_i$>6 mm (therefore producing negligible jetting and fluid mixing). This method is comparable to current industrial practice. For the current density conditions employed, insufficient mass transport enhancement was produced in the depleted concentration boundary layer, and poor to very poor quality copper was produced, as indicated by the clearly visible, highly nodulised, dendritic surface of the cathode.

In the second trial, a discharge sparger unit ($d_i$=2 mm) was used to introduce the electrolyte and gas into the cell, and excellent cathode was produced at 600 A $m^{-2}$. The quality of the cathode from visual inspection was very good, with little apparent evidence of dendrites and only a low number of small nodules present in a vertical band around the centre of the cathode. These results are considered to be considerably superior to current techniques.

A further prototype for testing the method of the invention was constructed and details of the prototype and experimental results are set out in Example 1 below.

EXAMPLE 1

In the prototype, there were fifty-four cathode electrodes 22 and fifty-five anode electrodes 20. The spacing of the electrode plates was 101.6 mm. Manifold lines 26 and 28 were constructed in the layout as shown in FIG. 2, the outer conduit being 2" schedule 40 PVC pipe and the inner conduit 36 being 1¼" schedule 40 PVC pipe. Two hundred and eighteen discharge nozzles 46 were provided and each of these produced jets 53 of approximately 0.7 metres laterally into the cell. Each discharge nozzle 46 had an outlet orifice of 1.75 mm. The initial operating conditions are set out in Table 3 below.

TABLE 3

Initial EW Conditions

| PARAMETER | VALUE | COMMENTS |
|---|---|---|
| Electrolyte flow | 140–150 1/mm | |
| Electrolyte line pressure | ~100 kPa | |
| Compressed air flow | 40 1/mm | Target was 20–25% of |

TABLE 3-continued

| Initial EW Conditions | | |
|---|---|---|
| PARAMETER | VALUE | COMMENTS |
| | | electrolyte flow |
| Compressed airline pressure | <150 kPa | |
| Humidifier water flow | 4–5 l/h | |
| Average cathode current | 686 A | Measured after 1 hour of EW |
| Std Dev of cathode currents | 42 A | Measured after 1 hour of EW |
| Average current density | 325 $A/m^2$ | |

After about 100 hours of deposition time, copper was harvested from the cathode electrodes. The average current during deposition was 35.2 kA which corresponds to a current efficiency of about 93%.

It is considered that the results of the testing of the prototype were very satisfactory.

Many modifications will be apparent to those skilled in the art without departing from the spirit and scope of the invention.

What is claimed is:

1. A method of operating a cell for electrowinning of copper, said cell including a plurality of anodes and cathodes therein, the method including the steps of introducing fresh electrolyte and sparging gas to a manifoid system in the cell, controlling flow of fresh electrolyte and sparging gas in the manifold system and providing outlet openings in the manifold system such that streams of fresh electrolyte and sparging gas from the outlet openings are directed relatively uniformly across the cathodes in the cell.

2. A method as claimed in claim 1 including the step of providing separate conduits for supplying fresh electrolyte and sparging gas in the manifold system and the method further includes the step of providing discharge nozzles which extend from the fresh electrolyte conduit through the sparging gas conduit to entrain sparging gas into the fresh electrolyte prior to being expelled through said outlet openings.

3. As method as claimed in claim 1 wherein each cathode is in the form of a plate having a lower edge and wherein said outlet openings produce streams of fresh electrolyte and sparging gas which are initially directed generally parallel to the lower edge.

4. A method as claimed in claim 3 including the step of providing four of said outlet openings for each cathode plate.

5. A method as claimed in claim 1 wherein the sparging gas is air.

6. A method as claimed in claim 1 wherein the sparging gas is from 10% to 30% by volume of fresh electrolyte in said streams.

7. A method as claimed in claim 1 wherein the sparging gas is air and is entrained in the streams of fresh electrolyte as bubbles having sizes in the range from 0.5 mm to 3.0 mm.

8. A method as claimed in claim 2 wherein sparging gas is supplied at a higher pressure than the fresh electrolyte.

9. A method as claimed in claim 8 wherein the sparging gas is supplied at a pressure which is from 25% to 75% lighter than the pressure of the fresh electrolyte.

10. A method as claimed in claim 1 including the step of providing outlet openings having diameters in the range 1.9 mm to 2.5 mm.

11. A method as claimed in claim 1 including the step of passing electric current between adjacent anodes and cathodes and wherein the current density of said current is in the range 300 to 600 $Am^{-2}$.

12. A cell for electrowinning of copper, the cell including a tank for holding electrolyte, a plurality of alternately disposed electrodes and cathodes, a manifold system for supplying fresh electrolyte and sparging gas to the cell, the arrangement being such that the manifold includes means for controlling flow of fresh electrolyte and sparging gas therein whereby streams of fresh electrolyte and sparging gas discharge from the manifold system relatively uniformly as between the cathodes in the cell.

13. A cell as claimed in claim 12 wherein the cathodes are in the form of cathode plates which are parallel to one another and each having a horizontally disposed lower edge and wherein the manifold system has outlet openings which direct streams of fresh electrolyte and sparging gas generally parallel to said bottom edges.

14. A cell as claimed in claim 13 wherein each of the cathode plates has bottom corners and wherein the outlet openings are located outwardly adjacent to bottom corners of the cathode plates.

15. A cell as claimed in claim 12 wherein the manifold includes an inner conduit which supplies fresh electrolyte and an outer conduit which supplies sparging gas and wherein the inner conduit is concentrically disposed within the outer conduit.

16. A cell as claimed in claim 15 wherein a plurality of discharge nozzles extend from the inner conduit through the outer conduit so as to discharge jets of fresh electrolyte having sparging gas entrained therein.

17. A cell as claimed in claim 16 wherein each discharge nozzle has a longitudinally extending bore.

18. A cell as claimed in claim 17 wherein the diameter of the bore is in the range 1.9 mm to 2.5 mm.

19. A cell as claimed in claim 17 wherein each nozzle has a shank and said bore is concentric therewith.

20. A cell as claimed in claim 19 wherein the shank includes a transverse opening having an inner end opening to said bore and an outer end which is located intermediate of said inner and outer conduits whereby in use fresh electrolyte passes from the inner conduit through the bores of the discharge nozzles and sparging gas located between the inner and outer conduits passes through the outer ends of said transverse openings and is entrained in the fresh electrolyte passing through said bores.

21. A cell as claimed in claim 20 wherein said transverse opening is about 1.2 mm in diameter.

22. A cell as claimed in claim 12 wherein said means for controlling the flow of fresh electrolyte and sparging gas therein is arranged to supply the sparging gas at a higher pressure than the pressure of the fresh electrolyte.

23. A cell as claimed in claim 12 wherein said means for controlling the flow of fresh electrolyte and sparging gas therein is arranged to supply the sparging gas at a flow rate which is from 10% to 30% of the flow rate of the fresh electrolyte.

24. A manifold for use in an electrolytic cell, the manifold including:

an inner conduit;

an outer conduit, the inner conduit extending longitudinally within the outer conduit to define a sparging gas supply passage;

as least one discharge nozzle, the nozzle having a bore therethrough, the bore having an inlet end which is located within the inner conduit and a discharge outlet end which is located laterally beyond the outer conduit, the nozzle further including an opening having an outer end which is in communication with said sparging gas passage and an inner end which is in communication with said bore, the arrangement being such that, in use, fresh electrolyte is supplied to the inner conduit and sparging gas is sufficient to said sparging gas supply passage and fresh electrolyte passes through the bore and entrains sparging gas from said passage into the bore through said opening whereby fresh electrolyte and sparging are discharged from the discharge outlet end of said bore.

25. A manifold as claimed in claim 24 wherein a plurality of said discharge nozzles are spaced along said conduits.

* * * * *